US009352594B1

(12) United States Patent
Perego

(10) Patent No.: US 9,352,594 B1
(45) Date of Patent: May 31, 2016

(54) PROCESS AND APPARATUS FOR DIGITAL PRINTING ON ARTICLES

(71) Applicant: TAPEMATIC S.P.A., Ornago (Monza Brianza) (IT)

(72) Inventor: Luciano Perego, Merate (IT)

(73) Assignee: TAPEMATIC S.P.A., Ornago (IT)

( * ) Notice: Subject to any disclaimer, the term of this patent is extended or adjusted under 35 U.S.C. 154(b) by 0 days.

(21) Appl. No.: 14/755,713

(22) Filed: Jun. 30, 2015

(30) Foreign Application Priority Data

Jun. 30, 2015 (EP) ..... 15174694

(51) Int. Cl.
*B41J 2/01* (2006.01)
*B41J 15/04* (2006.01)

(52) U.S. Cl.
CPC ..... *B41J 15/04* (2013.01)

(58) Field of Classification Search
CPC ..... B41J 11/06; B41J 11/0065; B41J 11/007; B41J 11/0085; B41J 13/103
USPC ..... 347/104, 107; 101/35
See application file for complete search history.

(56) References Cited

U.S. PATENT DOCUMENTS 3,363,546 A 1/1968 Johnson
3,796,718 A * 3/1974 Benford, Jr. ..... C03C 17/02 523/170
5,317,967 A 6/1994 Heidenreich
2007/0039490 A1* 2/2007 Aichele ..... B41F 15/12 101/35
2008/0247858 A1 10/2008 Lourman et al.
2009/0133593 A1* 5/2009 Till ..... B41J 11/002 101/35
2011/0273726 A1 11/2011 Beckhaus
2015/0033964 A1 2/2015 Perego

FOREIGN PATENT DOCUMENTS

DE 10 2011 009393 A1 7/2012
EP 0 535 512 A1 4/1993
WO 2007/042673 A1 4/2007
WO 2010/108527 A1 9/2010

* cited by examiner

*Primary Examiner* — Manish S Shah
*Assistant Examiner* — Roger W Pisha, II
(74) *Attorney, Agent, or Firm* — Pearne & Gordon LLP

(57) ABSTRACT

Articles each having a reference mark located around a respective extension axis, are loaded on piece-holder assemblies distributed around a central axis of a rotatable drum, and each including a pair of spindles operable in rotation by a same motor, each around a respective longitudinal axis. The drum rotates about said central axis to transfer said piece-holder assembly to a printing station, where a printing pattern is formed on a side surface of each article driven in rotation by the respective spindle. Before transferring to the printing station, at least one of the articles is oriented around the respective spindle, to place the reference marks of the articles along a same angular orientation around the respective extension axes.

14 Claims, 4 Drawing Sheets

PROCESS AND APPARATUS FOR DIGITAL PRINTING ON ARTICLES

Figure 1:
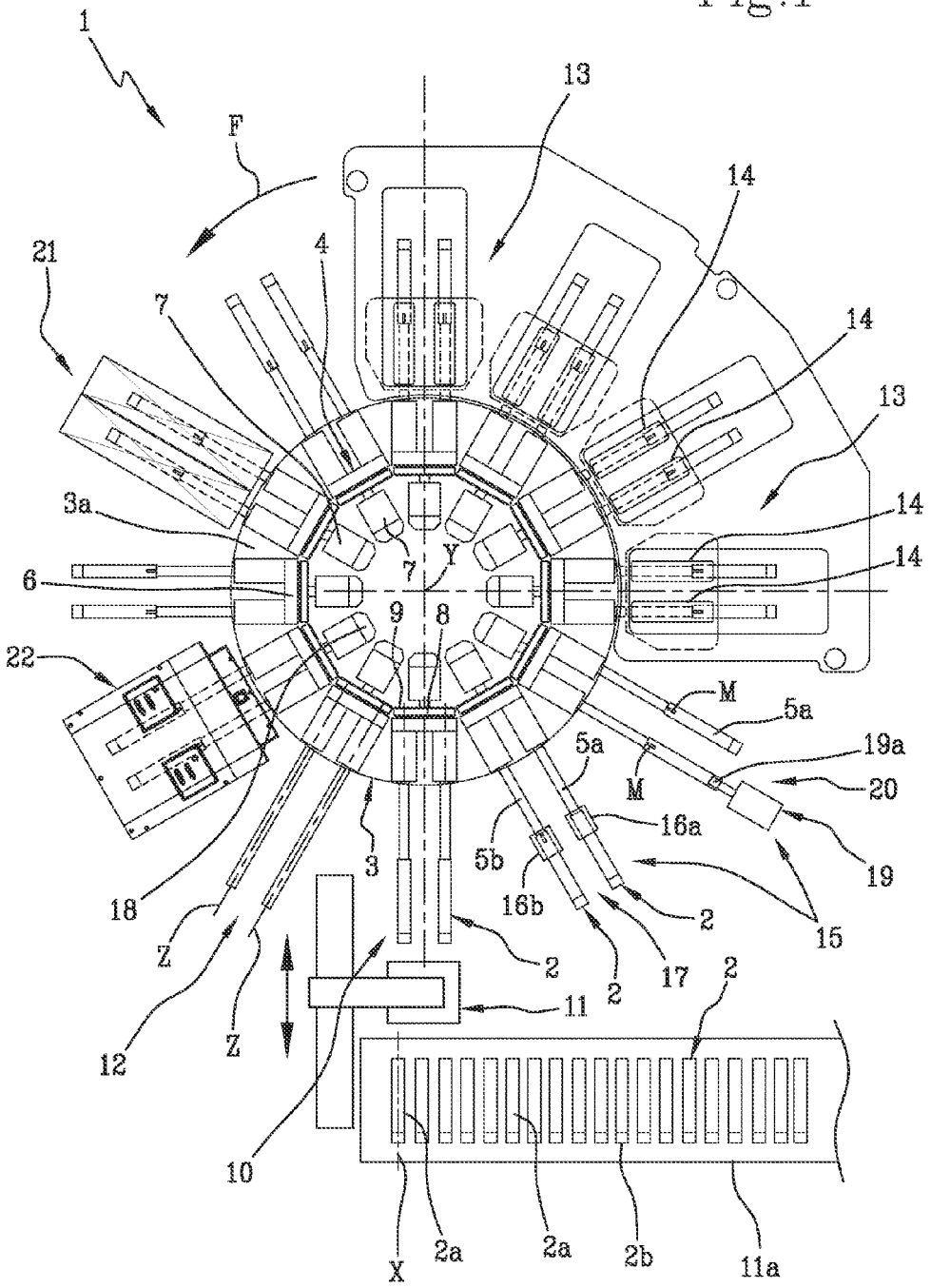

The present invention refers to a process for digital printing on articles. It is also an object of the invention an apparatus for digital printing usable to implement said process.

More particularly, the invention aims to perform a digital printing, in particular an ink-jet digital printing, on articles such as bottles, tubes, containers, closure elements, and more generally any three-dimensional article comprising at least one side surface which extends around an extension axis of the object, and a base surface having, for example, an orientation perpendicular to said extension axis.

Such objects have preferably an axially symmetrical shape, for instance a cylindrical, conical or frusto-conical shape, with a circular base. In this case, the extension axis defines the axis of symmetry, the side surface is given by the surface wrapped around the extension axis, and the base surface is given from the base of the cylinder or the frusto-conical body. An alternative may provide a shape having an oval base, but where appropriate prismatic articles may be provided, for example having a quadrangular or polygonal base.

The printing of decorations, lettering or symbols on the surface of such articles is known, for example to increase the aesthetic appearance, to bring product information, and/or to allow for their identification.

In this respect, one of the methods currently used comprises using the digital printing, which prints graphic patterns directly on the surfaces of articles from a computer data file, without the use of slabs, frames, plates, or the like.

For example, in the document US-2015-0033964-A1 by the same applicant, an apparatus for digital printing is described, comprising a rotatable drum carrying a plurality of spindles operable in rotation by respective motors, and each adapted to the engagement of an article being processed. The drum is driven in rotation to shift sequentially the articles through one or more printing stations. In each printing station, at least one printhead operates, below which each spindle is temporarily stationary to allow performing of printing. During the printing process, the printhead is face the side surface of the article so as to reproduce a desired printing pattern, by dispensing ink according to a plurality of points distributed along a substantially linear dispensing area, which is parallel to the extension axis of the article.

In the printing stage, the article is rotated about its longitudinal axis, so as to transfer the printing pattern on the whole extension of the side surface around the extension axis.

To achieve a structural simplification and increase productivity, each of the drive motors is operatively connected, by means of a kinematic transmission chain, to a pair of spindles. The spindles belonging to each pair are suitable to be simultaneously transferred to the printing station and/or to other work stations, to process at the same time the articles carried thereby.

The use of the apparatuses described above is, however, quite problematic when requiring the execution of digital printing on articles which bear already on their outer surface patterns previously made, for example, by screen printing, or geometric or low-relief patterns, or of another type.

In fact, it is practically impossible to obtain the desired positioning of the graphic patterns created by digital printing, relative to the graphic or geometric patterns already made on the article.

In particular, the Applicant has found that, since the articles are loaded onto respective spindles at a random orientation around the respective extension axis, it would become practically impossible to obtain the correct positioning of the printed graphic patterns on both articles loaded on a same pair of spindles, even in the case of a correct positioning of one of them.

The main object of the present invention is to overcome the limits of the drawbacks of the prior art.

In accordance with the present invention, it was found that by synchronizing suitably the orientation of the articles carried by the same pair or assembly of spindles driven by the same motor, it is possible to give the graphic patterns made by digital printing a predetermined positioning as compared to any other graphic patterns previously made on the articles being processed, without having to this end to take special measures during the loading step of the articles and without causing any loss of productivity.

In accordance with the present invention, the technical task mentioned and the aims specified are substantially achieved by a process and/or an apparatus for digital printing on articles, comprising the technical characteristics set out in one or more of the appended claims.

In particular, in accordance with a first aspect, it is an object of the invention a digital printing process on articles, each having an angular reference mark localized around a respective extension axis, comprising: loading a plurality of articles on piece-holder assemblies distributed around a central axis of a rotatable drum, and each comprising at least a first and a second spindle operable simultaneously in rotation by a same motor, each around a respective longitudinal axis; rotating the drum about said central axis for transferring said piece-holder assembly to a printing station; printing a printing pattern on a side surface of each article carried in the printing station, while the article is driven in rotation by the respective spindle. It is advantageously provided that, before transferring to the printing station, at least one of the articles is oriented around the respective spindle, to place the reference marks of the articles according to a same angular orientation around the respective extension axes.

In accordance with a further aspect, it is an object of the invention an apparatus for digital printing on articles, wherein each article has an angular reference mark localized around a respective extension axis, comprising: a drum rotatable around a central axis; a plurality of piece-holder assemblies carried by the drum, circumferentially distributed around said central axis and each comprising at least a first and a second spindle operable simultaneously in rotation by a same motor, each around a respective longitudinal axis; loading devices for engaging an article being processed on each spindle; advancement devices operating on the drum for sequentially transferring the piece-holder assemblies to least a printing station; at least one ink-jet printhead, installed in said printing station for printing a printing pattern on a side surface of each article, while the latter is driven in rotation around a respective extension axis by the respective spindle. Advantageously, synchronization devices are also provided, which are operatively disposed between the loading devices and the printing station, for orienting around the respective spindle at least one of the articles carried by each of the piece-holder assemblies, so as to place the angular reference marks of the articles according to a same angular orientation around their respective extension axes.

The articles being processed are thus suitable to reach the printing station with a predetermined and constant orientation. This allows the accurate realization of printing patterns with a desired positioning with respect to the graphic and/or geometric elements previously made on the article being processed. By way of example, images or lettering can be printed with a perfectly cantered position within a frame made earlier, already present on the article taken from the feed line.

In at least one of the above aspects, the invention also comprises one or more of the following preferred characteristics.

Preferably, the orientation of said at least one article around the respective spindle comprises the steps of: simultaneously driving in rotation the spindle being part of said piece-holder assembly; selectively stopping rotation of at least one of the articles during the rotation of the spindles.

Preferably, during the simultaneous actuation in rotation of the spindles, the following actions are performed: detecting the passage of the reference mark carried by the article loaded on a first spindle, at a first reading position localized around the extension axis of the first spindle; detecting the passage of the reference mark carried by the article loaded on a second spindle, at a second reading position located around the extension axis of the second spindle.

Preferably, it also includes the detecting of an angular offset between the reference marks of the articles loaded on the first and the second spindles, respectively.

Preferably, the action of selective stopping rotation is stopped when the rotation of the spindles has reached an angular amplitude equal or explementary to the detected angular offset.

Preferably, it also provides for the procedures of detecting and storing the angular excursion accomplished by the spindles from the detection of the passage at the first reading position to the detection of the passage at the second reading position.

Preferably, after the loading step, the drum is driven in rotation for transferring said piece-holder assembly to a reading station, where at least the detecting of the passage at the first reading position is performed.

Preferably, after detecting the passage at the second reading position, performed at the reading station, the drum is driven in rotation for transferring said piece-holder assembly from the reading station to a synchronization station, where the action of selective stopping rotation is performed.

Preferably, after detecting the passage at the first reading position, performed at the reading station, the drum is driven in rotation for transferring said piece-holder assembly to a synchronization station, where the action of selective stopping rotation of the article loaded on the second spindle during the rotation of said spindles is performed, until to said detection of the passage at the second reading position.

Preferably, in conjunction with the detection of the passage at the first reading position, the selective stopping procedure of the rotation of the article loaded on the second spindle during the rotation of said spindles is performed, until to said detection of the passage at the second reading position.

Preferably, said synchronization devices comprise reading devices to detect an angular offset between the reference marks of the articles loaded on the first and the second spindles, respectively.

Preferably, said reading devices comprise: a first sensor operating at a first reading position localized around the extension axis of the first spindle being part of one of said piece-holder assemblies, to detect the presence, at said first reading position, of the reference mark carried by the article loaded on the first spindle; a second sensor operating at a second reading position localized around the extension axis of the second spindle being part of the same piece-holder assembly, to detect the presence, at said second reading position, of the reference mark carried by the article loaded on the second spindle.

Preferably, the synchronization devices also comprise at least one encoder associated with the motor belonging to said piece-holder assembly, to detect an angular offset between the reference marks of the articles loaded on the first and the second spindles, respectively.

Preferably, said synchronization devices comprise clamping devices for selectively stopping rotation of at least one of the articles during the rotation of the spindles.

Preferably, said clamping devices comprise at least one gripping organ which operates on an outer surface of the article.

Preferably, said reading devices operate at a reading station located downstream of a loading station in which said loading devices operate.

Preferably, said clamping devices operate at a synchronization station located downstream of the reading station.

Preferably, said first sensor and the second sensor operate at the reading station.

Alternatively, said first sensor and said second sensor operate at the reading station and at the synchronization station.

Figure 3:
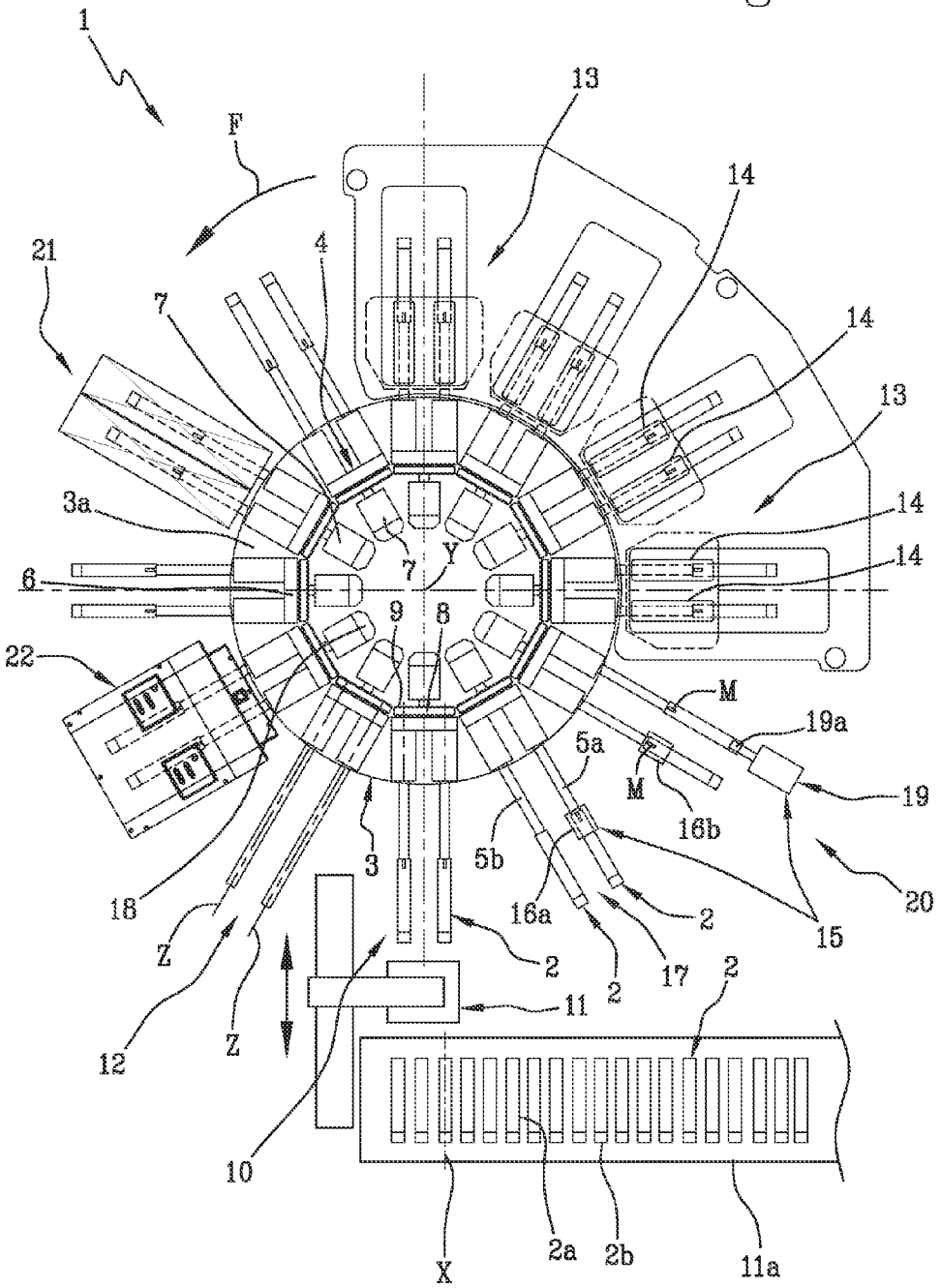

Further characteristics and advantages of the present invention will become more apparent from the description of an exemplary, but not exclusive, and therefore non-limiting preferred embodiment of a process and apparatus for digital printing on articles, as illustrated in the appended figures, in which:

FIG. 1 shows a schematic top view of an apparatus according to the present invention;

FIGS. 2*a*, 2*b*, 2*c* and 2*d* show a schematic cross-sectional view, taken radially away from the central axis of rotation of the drum, of a pair of articles loaded onto respective spindles during a synchronization procedure on the apparatus of FIG. 1;

FIG. 3 shows a schematic top view of an alternative embodiment of the apparatus of FIG. 1;

FIGS. 4*a*, 4*b*, 4*c* and 4*d* show a schematic cross-sectional view, taken radially away from the central axis of rotation of the drum, of a pair of articles loaded onto respective spindles during a synchronization procedure on the apparatus of FIG. 3.

With reference to the attached figures, the number 1 globally indicates an apparatus for digital printing on articles 2, according to the present invention.

Each article 2 can be realized by an element, for example, a prismatic, frusto-conical, or cylindrical element, as in the illustrated example, having at least one side wall defining a side surface 2*a* and at least a possible base wall 2*b*. Preferably, the side wall and the base wall define an internal cavity. It should be noted that other forms are suitable for the purpose, such as for example pyramid-shape prisms or oval-section cylinders.

In general, the side surface 2*a* extends around an extension axis X of the article 2. Typically, the extension axis X is a major extension axis, i.e., it defines the direction along which the article has the greater dimension.

The article 2 can be made with any material, for example plastic, metal or paper, or a vitreous material.

The apparatus 1 comprises a drum 3 rotatable about an own central axis Y. The drum 3 has an axially symmetrical shape with respect to its central axis Y, for example a substantially circular shape. The drum 3 has a base surface 3*a*, which is preferably flat, preferably horizontal. The central axis Y is preferably perpendicular to the base surface 3*a* of the drum 3. In other words, the central axis Y is arranged along a vertical direction.

Around the central axis Y of the drum 3, preferably along a peripheral zone of the drum itself, a plurality of piece-holder assemblies 4 is distributed, each comprising at least a first spindle 5*a* and a second spindle 5*b*, each configured to accommodate a respective article 2 to be elaborated.

Each of the spindle 5*a*, 5*b*, preferably coplanar with one another, is rotatably engaged to a support 6 integral with the drum 3.

Preferably, each spindle 5*a*, 5*b* extends away from the support 6, in a substantially radial direction with respect to the central axis Y, for example along a longitudinal axis Z parallel to the base surface 3*a* of the drum 3. Each spindle 5*a*, 5*b* is suitable to engage one of the articles 2, which is, for example, coaxially fitted on the spindle itself, and to suitably hold them during the processing, for example by means of a suction action exerted by the spindle itself.

A plurality of drive motors 7, for example attached to the base surface 3*a* of the drum 3 and distributed circumferentially around the central axis Y, drives in rotation the spindle 5*a*,5*b* around the respective longitudinal axes Z, so that also the articles 2, engaged on the spindles themselves, are driven in rotation around their respective extension axes X.

It is preferably provided that each motor 7 is controlled by a respective piece-holder assembly 4. More particularly, the spindles 5*a*,5*b* of each piece-holder assembly 4 may be operatively connected to the same motor 7 by means of a kinematic transmission comprising, for example, a toothed belt 8 engaged on respective pulleys 9. Consequently, the spindles 5*a*,5*b* belonging to a same piece-holder assembly 4 are simultaneously driven in rotation by the same motor 7.

In the illustrated embodiment, each piece-holder assembly 4 comprises a pair of spindles 5*a*,5*b*, namely a first spindle 5*a*,5*b* and a second spindle, preferably parallel to one another. It may be, however, provided the presence of three or more spindles 5*a*,5*b* for each piece-holder assembly 4.

By means of suitable advancement devices, which are not illustrated since realizable in a known manner, the drum 3 is suitable to be driven in rotation around a respective central axis Y, preferably by a step-by-step movement, along an advancement direction indicated by the arrow F in the FIGS. 1 and 3. In particular, the drum 3 is operated in movement steps each having an amplitude equal to the angular distribution pitch of the piece-holder assemblies 4 and of the respective drive motors 7 around the central axis Y of the drum itself.

Following the step-by-step movement of the drum 3, each piece-holder assembly 4 is transferred sequentially through a plurality of work stations distributed around the drum 3.

More particularly, there is provided a loading station 10 in which suitable loading devices 11, which are not illustrated in detail since realizable in a known manner, engage the articles 2 on the spindles 5*a*,5*b*, the articles coming, for example, from a feed line 11*a*. In particular, each article 2 is preferably fitted coaxially on the respective spindle 5*a*, 5*b*.

In an unloading station 12, preferably placed adjacent the loading station 10, the processed articles 2 are removed from the respective spindles 5*a*, 5*b*.

The rotation of the drum 3 causes the articles 2 to be transferred along a circular path around a respective central axis Y, from the loading station 10 to the unloading station 12.

Between the loading station 10 and unloading station 12, along the path traveled by the articles 2 moved around the central axis Y of the drum 3, one or more printing stations 13 operate. In the example shown, where the apparatus 1 is designed for four-colour CMYK printing, there are four printing stations 13, each of which comprises at least one printhead 14, preferably an ink-jet printhead, suitable to be used for printing with a respective colour, i.e., Yellow, Magenta, Cyan, and Black, respectively. In the illustrated example, at each printing station 13 a pair of printheads 14 is associated, which is arranged parallel to the longitudinal axes Z of the spindles 5*a*,5*b*, to operate simultaneously each on the side surface 2*a* of one of the articles 2 carried by a same piece-holder assembly 4.

Through the rotation of the drum 3, the articles 2 carried by each of the piece-holder assemblies 4 are sequentially subjected to the action of each of the printing stations 13, so that on its side surface 2*a* of each of them an image, for example a four-colour image, can be reproduced, that is, an image resulting from the composition of four graphic patterns respectively produced with the various colours, each in one of the printing stations 13. The production of one-colour images, or of two or more colours images by means of the activation of a corresponding number of printing stations 13, is also contemplated.

An electronic control unit, not shown in the accompanying drawings, controls the operation of the apparatus 1.

The control unit can be divided into distinct functional modules (memory modules or operating modules) or else constituted by a single electronic device, suitably programmed to perform the described functionalities, in which the various modules may correspond to hardware entities and/or software routines being part of the programmed device.

Alternatively or in addition, such functionalities can be performed by a plurality of electronic devices on which the aforesaid functional modules can be distributed.

The control unit may use one or more processors for executing the instructions contained in the memory modules. In addition, these functional modules can be distributed over several, local or remote computers according to the network architecture in which they reside.

More particularly, by way of indication, the control unit may comprise at least one processing module programmable with the files relating to the graphic patterns to be printed on the articles 2 being processed. An actuation module acquires signals from the processing module and controls the selective dispensing of the ink from the printheads 14, in conjunction with the activation of the motor 7, which, by driving in rotation the articles 2, determine the movement of their side surfaces 2*a* transversely to the main extension direction of the printheads 14.

Printing patterns can therefore be created extending over the entire extension of the side surfaces 2*a* of the respective articles 2, or only on a part of them.

The articles 2 from the feed line 11*a* may have graphic elements already printed in a previous processing step, for instance by screen printing, or geometric elements formed in a previous moulding step. The printing patterns produced by the apparatus 1 must have an accurate and predetermined positioning with respect to the graphic and/or geometric elements already made on the articles 2 that reach the loading station 10. In this respect, it is provided that each article 2 has at least a reference mark, schematically indicated with M in FIGS. 2 and 4, located around a respective extension axis. Said reference mark M can be constituted, for example, by a notch made by printing or in relief on the side surface 2*a* of the article 2, or from a part of the same graphic or geometric element prepared on the article 2 itself. In the illustrated example, the reference mark M is made at an end edge of the article 2 opposite to its base wall 2*b*.

The articles 2 engaged on the spindles 5*a*,5*b* at the loading station 10 may advantageously have their respective reference marks M arranged in a random placement around the respective extension axes X.

In accordance with the present invention, between the loading devices 11 and the printing stations 13, synchronization devices 15 operate, which are configured to orient around the respective spindle 5*a*,5*b* at least one of the articles 2 carried by each piece-holder assembly 4. More particularly, thanks to the action of the synchronization devices 15, at least one of the articles 2 being part of a same piece-holder assembly 4 is oriented so that, once the orientation is complete, the reference marks M of all the articles 2 being part of the same piece-holder assembly 4 have a same angular orientation around their respective extension axes X.

Preferably, the synchronization devices 15 comprise reading devices 16*a*, 16*b* configured to detect an angular offset between the reference marks M of the articles 2 loaded on the first spindle 5*a* and the second spindle 5*b*, respectively, belonging to the same piece-holder assembly 4.

Preferably, the reading devices 16*a*, 16*b* comprise a first sensor 16*a* and a second sensor 16*b* operating, for example, at a reading station 17 arranged downstream of the loading station 10. Preferably, the first sensor 16*a* and the second sensor 16*b* are rigidly engaged to a fixed supporting structure (not shown). Each time the drum 3 performs a movement step, the articles 2 carried respectively by the first spindle 5*a* and the second spindle 5*b* of the same piece-holder assembly 4 are each positioned near one of the sensors 16*a*, 16*b*.

More particularly, the first sensor 16*a* operates at a first reading position L1 localized around the longitudinal axis Z of the first spindle 5*a*, 5*b*. The second sensor 16*b* operates, in turn, at a second reading position L2, localized around the longitudinal axis Z of the second spindle 5*b*.

Each of the sensors 16*a*, 16*b*, for example comprising photocells, is configured to detect, at the respective reading position L1, L2, the presence of the reference mark M carried by the article 2 loaded on the respective spindle 5*a*, 5*b*. For example, for this purpose it may be provided that each sensor 16*a*, 16*b* is suitable to emit a signal when the reference mark M carried by the article 2 loaded on the respective spindle 5*a*,5*b* reach the respective reading position L1, L2.

At least one encoder 18 associated with each drive motor 7 allows to detect the angular offset between the reference marks of the articles M 2 loaded on the first spindle 5*a* and the second spindle 5*b*, respectively, belonging to a same piece-holder assembly 4.

The synchronization devices 15 also comprise clamping devices 19 for selectively stopping the rotation of at least one of the articles 2 during the rotation of the spindles 5*a*, 5*b*. Preferably, the clamping devices 19 comprise at least one gripping organ 19*a*, for example of the pneumatic type with two or more jaws, installed in a synchronization station 20 arranged downstream of the reading station 17 and that can be selectively activated to perform a gripping action on the side surface 2*a* of one of the articles 2 carried by the spindles 5*a*,5*b* belonging to the same piece-holder assembly 4.

In the embodiment of FIG. 1, both the first sensor 16*a* and the second sensor 16*b* are installed in the reading station 17. In the example of FIG. 3, however, only the first sensor 16*a* is installed in the reading station 17, while the second sensor 16*b* operates in the synchronization station 20. Following an angular rotation of the drum 3, each piece-holder assembly 4, previously loaded with the articles 2 being processed, is transferred from the loading station 10 to the reading station 17, where both the first and the second sensors 16*b* operate. The reference marks M carried by each of the articles 2 each has a random positioning around the respective extension axis X. Upon reaching the reading station 17, the first spindle 5*a* and the second spindle 5*b* are simultaneously driven in rotation by the drive motor 7. Consequently, the reference marks M carried by the articles 2 loaded on the first spindle 5*a* and the second spindle 5*b*, respectively, begin to rotate around their respective extension axes X.

Figure 2A:
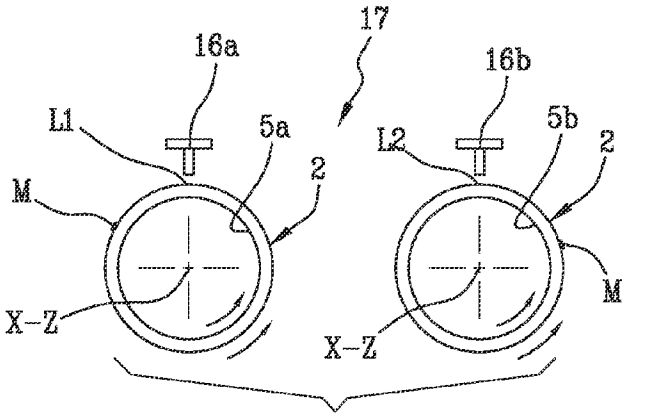
Figure 2B:
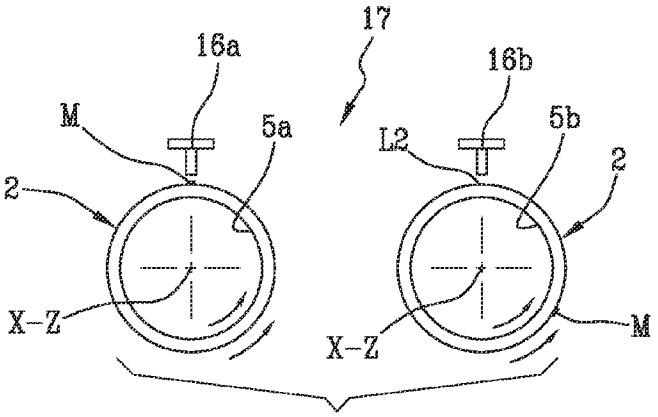

In the example illustrated in FIG. 1 and in FIGS. 2*a*-2*d*, during the driving in rotation of the spindles 5*a*,5*b* at the reading station 17, the first sensor 16*a* and the second sensor 16*b* are activated to detect the passage of the reference marks M at the respective reading positions L1, L2 (FIG. 2*a*).

Figure 2C:
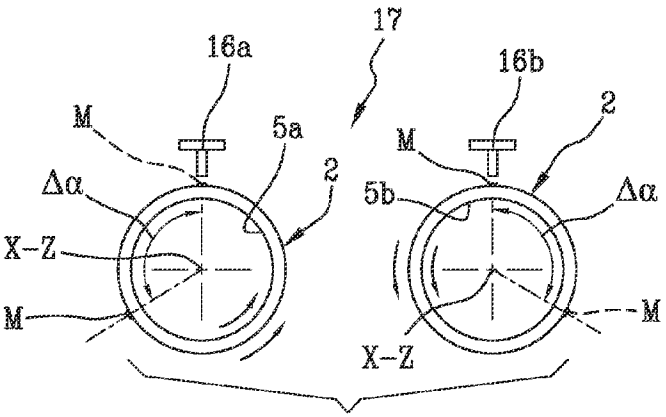

When the first sensor 16*a* detects, at the first reading position L1, the passage of the reference mark M carried by the article 2 loaded on the first spindle 5*a* (FIG. 2*b*), the detection of the angular excursion accomplished by the spindles 5*a*, 5*b* is enabled, until the second sensor 16*b*, which operates at the second reading position L2, detects the passage of the reference mark M carried by the article 2 loaded on the second spindle 5*b* (FIG. 2*c*). Such detection may, for example, be entrusted to the encoder 18 coupled to the drive motor 7.

The value of the angular excursion, representative of a mutual angular offset $\Delta\alpha$ between the reference marks M of the articles loaded on the first spindle 5*a* and the second spindle 5*b*, respectively, is suitable to be stored in the aforesaid control unit to allow the subsequent stages of the angular synchronization procedure of the articles 2.

Figure 2D:
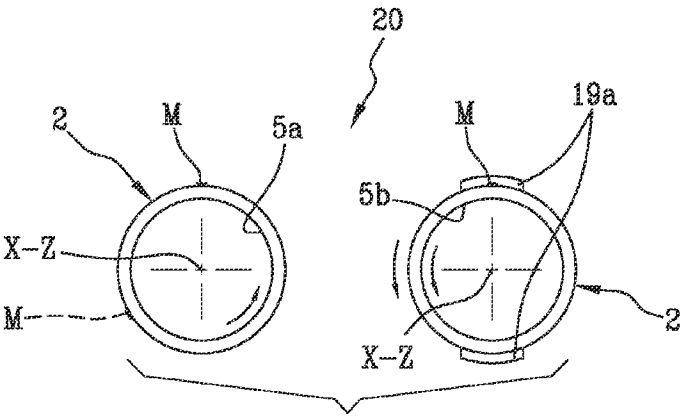

With a new angular rotation of the drum 3, the piece-holder assembly is transferred from the reading station 17 to the synchronization station 20. The gripping organ 19*a* is activated to retain the article 2 engaged to the second spindle 5*b*, while the motor 7 drives in rotation both the first spindle 5*a* and the second spindle 5*b* (FIG. 2*d*). Consequently, the second spindle 5*b* rotates within the article 2 selectively blocked by the gripping organ 19*a*, while the article 2 engaged to the first spindle 5*a* rotates together with the latter. The selective locking action by the gripping organ 19*a*, being controlled by the encoder 18, is interrupted when the rotation of the spindles 5*a*, 5*b* has reached an angular amplitude explementary to the angular offset $\Delta\alpha$ detected earlier (FIG. 2*d*), i.e., an angular amplitude which, when added to the angular offset $\Delta\alpha$, gives a value of 360°. At the same time, the rotation of the spindles 5*a*, 5*b* can be stopped so that both articles 2 have the respective reference marks M in a same positioning around the respective extension axes X. In the example of FIG. 2*d*, the reference marks M of both articles 2 are placed on top of the articles 2 themselves.

Figure 4A:
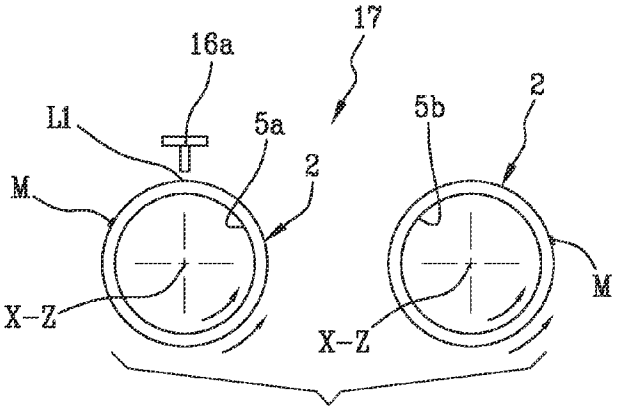
Figure 4B:
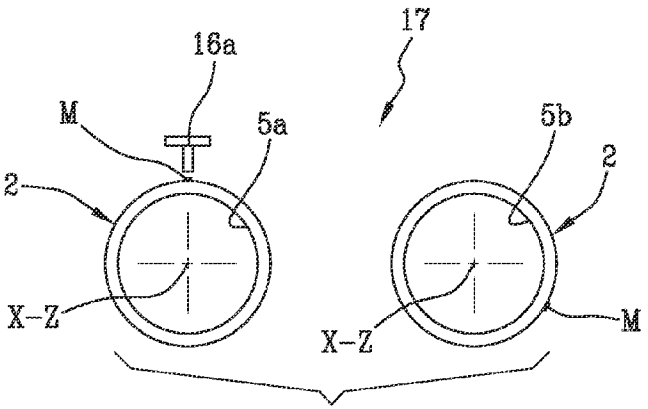

With reference to the example illustrated in FIGS. 3 and 4*a*-4*d*, the piece-holder assembly 4 at the reading station 17 is subjected to the action of the first sensor 16*a* alone, while both spindles 5*a*, 5*b* are driven in rotation by the respective drive motor 7 (FIG. 4*a*). As soon as the reference mark M carried by the article 2 fitted on the first spindle 5*a* reaches the first reading position L1, the first sensor 16*a* controls the stopping of the drive motor 7 and the consequent rotation of the spindles 5*a*, 5*b* (FIG. 4*h*).

Figure 4C:
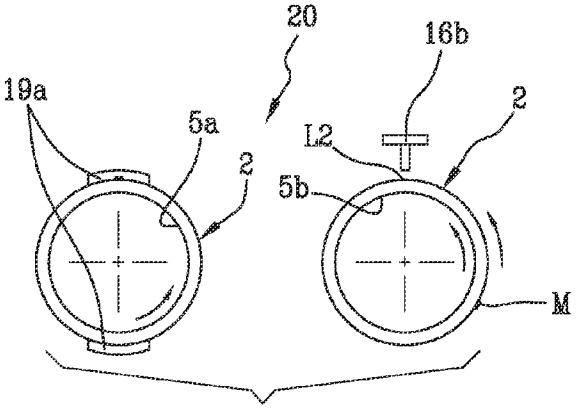
Figure 4D:
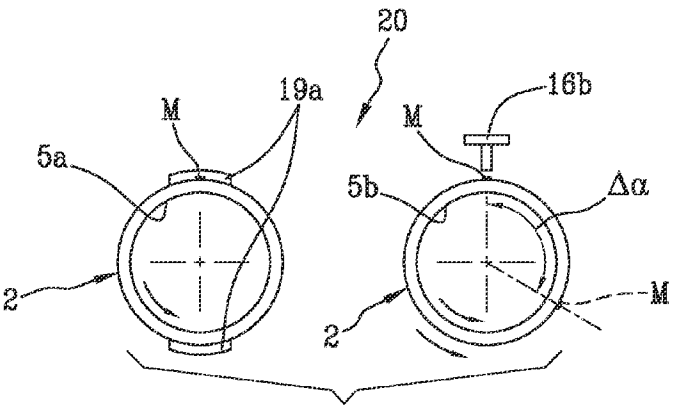

With an angular rotation of the drum 3 about the respective central axis Y, the piece-holder assembly 4 is transferred to the synchronization station 20. The gripping organ 19*a* is activated to retain the article 2 engaged to the first spindle 5*a*, while both spindles 5*a*, 5*h* are driven in rotation by the drive motor 7 (FIG. 4*c*). When the article 2 engaged to the second spindle 5*b* has made an angular excursion equal to the angular offset $\Delta\alpha$, the second sensor 16*b*, installed in the synchronization station 20, detects the passage of the respective reference mark M at the second reading position P2 (FIG. 4*d*), and consequently controls the interruption of the action of the gripping organ 19*a*. The rotation of the spindles 5*a*, 5*b* can therefore be stopped so that the reference marks M of both articles 2 have a same positioning around the respective extension axes X, for example at the top of the articles 2 themselves.

In a possible alternative embodiment (not illustrated), the synchronization devices 15 consisting of the first and second sensors 16*b* and the gripping element 19*a*, can be installed in a single station. In this case, it can be provided that, for example, in conjunction with the detection of the passage of the reference mark M at the first reading position L1, the gripping organ 19*a* causes the selective stopping of the rotation of the article 2 loaded on the first spindle 5*a*, in conjunction with the rotation of both spindles 5*a*, 5*b*, until the second sensor 16*b* detects the passage of the respective reference mark M at the second reading position L2.

Once the synchronization process is complete, the articles 2 associated to the same piece-holder assembly 4 have the respective reference marks M at the same predefined location, for example at the top of the articles themselves. The articles 2 are therefore suitable to be transferred to the printing stations 13 correctly oriented for the realization of the printing patterns at predetermined positions with respect to graphic and/or geometric elements already made on the article 2, with a high accuracy of positioning. Once the printing is complete, successive angular rotations of the drum 3, around a respective central axis Y, bring the articles 2 to the unloading station 12, after a passage through a possible cross-linking station 21 for the ink used in the printing, and a final control station 22.

The invention claimed is:

1. Digital printing process on articles, each having a reference mark located around a respective extension axis, comprising:

loading a plurality of articles on piece-holder assemblies distributed around a central axis of a rotatable drum, and each comprising at least a first spindle and a second spindle operable simultaneously in rotation by a same drive motor, each around a respective longitudinal axis;

rotating the rotatable drum about said central axis to sequentially transfer said piece-holder assembly to a printing station;

printing a printing pattern on a side surface of each article carried in the printing station, while the article is driven in rotation by the respective spindle;

wherein, before transferring to the printing station, at least one of the articles is oriented around the respective spindle, to place the reference marks of the articles according to a same angular orientation around the respective extension axes, wherein the orientation of said at least one article around the respective spindle comprises:

simultaneously driving in rotation the spindles being part of said piece-holder assembly;

selectively stopping rotation of at least one of the articles during the rotation of the spindles, wherein during the simultaneous driving in rotation of the spindles the following actions are performed:

detecting the passage of the reference mark carried by the article loaded on a first spindle, at a first reading position localized around the extension axis of the first spindle;

detecting the passage of the reference mark carried by the article loaded on a second spindle, at a second reading position located around the extension axis of the second spindle.

2. Process according to claim 1, further comprising:

detecting an angular offset between the reference marks of the articles loaded on the first spindle and the second spindle, respectively;

wherein the action of selective stopping rotation is stopped when the rotation of the spindles has reached an angular amplitude equal or explementary to the detected angular offset.

3. Process according to claim 1, wherein after the loading step, the drum is driven in rotation for transferring said piece-holder assembly to a reading station, where at least the detecting of the passage at the first reading position is performed.

4. Process according to claim 1, wherein after detecting the passage at the second reading position, performed at the reading station, the drum is driven in rotation for transferring said piece-holder assembly from the reading station to a synchronization station where the action of selective stopping rotation is performed.

5. Process according to claim 1, wherein after detecting the passage at the first reading position, performed at the reading station, the drum is driven in rotation for transferring said piece-holder assembly to a synchronization station where the action of selective stopping rotation of the article loaded on the second spindle during the rotation of said spindles is performed, until to said detection of the passage at the second reading position.

6. Process according to claim 1, wherein in conjunction with the detection of the passage at the first reading position, the selective stopping procedure of the rotation of the article loaded on the first spindle during the rotation of said spindles is performed, until to said detection of the passage at the second reading position.

7. Apparatus for digital printing on articles, wherein each article has a reference mark located around a respective extension axis, comprising:

a drum rotatable around a central axis;

a plurality of piece-holder assemblies carried by the drum, which are circumferentially distributed about said central axis, and each comprising at least a first spindle and a second spindle operable simultaneously in rotation by a same drive motor, each around a respective longitudinal axis;

loading devices for engaging an article being processed on each spindle;

advancement devices operating on the drum for sequentially transferring the piece-holder assemblies to least a printing station;

at least one ink-jet printhead, installed in said printing station for printing a printing pattern on a side surface of each article, while the latter is driven in rotation around a respective extension axis by the respective spindle;

characterized in that it comprises synchronization devices operatively disposed between the loading devices and the printing station, for orienting around the respective spindle at least one of the articles carried by each of the piece-holder assemblies, so as to place the reference marks of the articles according to a same angular orientation around their respective extension axes, wherein said synchronization devices comprise reading devices for detecting an angular offset between the reference marks of the articles loaded on the first spindle and the second spindle, respectively.

8. Apparatus according to claim 7, wherein said reading devices comprise:

a first sensor operating at a first reading position localized around the extension axis of the first spindle being part of one of said piece-holder assemblies, to detect the presence, at said first reading position, of the reference mark carried by the article loaded on the first spindle;

a second sensor operating at a second reading position localized around the extension axis of the second spindle being part of the same piece-holder assembly, to detect the presence, at said second reading position, of the reference mark carried by the article loaded on the second spindle.

9. Apparatus according to claim 7, wherein said synchronization devices comprise clamping devices for selectively stopping rotation of at least one of the articles during the rotation of the spindles.

10. Apparatus according to claim 7, wherein said reading devices operate at a reading station located downstream of a loading station in which said loading devices operate.

11. Apparatus according to claim 9, wherein said clamping devices operate at a synchronization station located downstream of the reading station.

12. Apparatus according to claim 8, wherein said first sensor and said second sensor operate at the reading station.

13. Apparatus according to claim 8, wherein said first sensor and said second sensor operate at the reading station and at the synchronization station, respectively.

14. Apparatus according to claim 9, wherein said clamping devices comprise at least one gripping element operating on an external surface of the article.

* * * * *